United States Patent [19]

Windall

[11] Patent Number: 4,511,146

[45] Date of Patent: Apr. 16, 1985

[54] PRACTICE GOLF NET DEVICE

[76] Inventor: Owen D. Windall, 1007 Oswego Rd., Napersville, Ill. 60540

[21] Appl. No.: 517,264

[22] Filed: Jul. 26, 1983

[51] Int. Cl.[3] ..... A63B 57/00

[52] U.S. Cl. ..... 273/181 J; 273/181 F; 273/185 R

[58] Field of Search ..... 273/181 R, 181 J, 183 R, 273/184 R, 185 R

[56] References Cited

U.S. PATENT DOCUMENTS

| | | | |
|---|---|---|---|
| 1,145,833 | 7/1915 | English et al. | 273/181 J |
| 1,371,820 | 3/1921 | Sochurek | 273/181 J |
| 1,443,412 | 1/1923 | Hutton | 273/181 J |
| 1,566,945 | 12/1925 | Winkley | 273/181 F |
| 1,652,270 | 12/1927 | Brun | 273/181 J |
| 3,001,795 | 9/1961 | Johnson, Jr. | 273/181 F |
| 3,091,466 | 5/1963 | Speiser | 273/181 J |
| 3,172,290 | 3/1965 | Slimovitz | 273/181 J |
| 3,197,208 | 7/1965 | Makar | 273/181 F |
| 3,550,450 | 12/1970 | Griffin | 273/185 R |
| 3,758,118 | 9/1973 | Willcox | 273/181 J X |

*Primary Examiner*—William H. Grieb

*Attorney, Agent, or Firm*—Robert D. Farkas

[57] ABSTRACT

A practice golf net device utilizes a fabric-like member suspended from a frame to which are attached a plurality of shroud lines. The lines are connected to a mechanism which reflects the impact location of a practice golf ball contacting the net when hung downwardly, in a drape-like condition. The mechanism faithfully reports the angle that the ball takes relative to a line normal to the center of the net—emanating from the central regions of the net, as well as reporting the loft angle assumed by the ball. After each ball contacts the net, a release cord is manually operated by the player which resets the entire mechanism, readying same to provide a visual display of the distance that the next ball will travel, the angle it will assume relative to the target angle, and the loft imparted to the ball.

15 Claims, 6 Drawing Figures

PRACTICE GOLF NET DEVICE

BACKGROUND OF THE INVENTION

1. The Field of the Invention

This invention relates to golf practicing devices, and more particularly to that class of apparatuses which are capable of displaying a measurement related to the distance that the ball would travel if permitted to do so, the angle that the ball assumes relative to a known line of intended trajectory and the loft which the ball receives—after being struck by the club of the practicing golfer—such that the ball is interrupted in its flight path and comes to a stopping position relatively close to the golfer, thereby conserving time and minimizing walking between practice ball strokes.

2. Description of the Prior Art

The prior art abounds with golf practicing apparatuses. Typical of such devices is the teaching illustrated in U.S. Pat. No. 1,443,412 issued to C. H. Hutton on Jan. 30, 1923. The Hutton patent describes a dynamometer approach to a practice curtain that is pretensioned. Upon impact, a ball permits a dynamometer-like device to register the amount of impact force perceived by the curtain, which force is translated to a scale permitting the user to interpret the distance that the ball would have traveled had it not been interrupted in its path by such curtain. The direction that the ball assumes is measured by observing the point of impact of the ball onto the screen relative to a series of lines printed on the screen, such that the user may gauge the accuracy of the direction which the ball follows.

U.S. Pat. No. 1,652,270 issued Dec. 13, 1927 to V. P. Brun similarly describes a ballistic impact measuring device which determines the force imparted upon a golf ball, interpreting same as to the distance the ball would have traveled had it not been interrupted in its flight path by a vertically draped sheet.

The shortcomings to the prior art are such that an inexpensive, efficient, light, compact and durable mechanism has not yet been taught, which could measure the impact of the ball—as a means of indicating its free-path traveling distance, but also a mechanism has not yet been described and which would also accurately and without player interpretation, provide data as to the actual direction that the ball travels—prior to impinging upon the target screen and also providing data as to the actual angle of loft of the ball, during its short flight. The loft taken by the ball, coupled with the driving force imparted to it, determines the distance that the ball will travel. The instant invention measures loft as well as force, and also measures and reports to the user the direction that the ball takes.

SUMMARY OF THE INVENTION

A primary object of the present invention is to provide a practice golf striking mechanism which signals the impact strength imparted to the ball, the direction that the ball takes—along a plane parallel to the ground plane, as well as the loft that the ball assumes after being struck.

Another object of the present invention is to provide an apparatus which can be erected indoors or outdoors, which apparatus gently returns the ball to an area intermediate the location of the player and the vertical screen positioned to terminate the ball's flight, a short distance away from the player.

Still another object of the present invention is to provide an apparatus which is rugged in its construction, capable of being utilized in rough conditions—without the need for electrical or electro-mechanical devices to operate same.

Yet another object of the present invention is to provide an apparatus which may include, if desired, an electrical readout—signalling the impact parameters imparted to the ball when striking same, for remote visual reading.

A further object of the present invention is to provide an apparatus which is resetable after each ball impacts upon same, so as to immediately permit a user to evaluate the effectiveness and efficiency which the ball has been struck by him.

A still further object of the present invention is to provide an inexpensive yet durable, easy to operate and convenient to install device, suitable for indoor and outdoor use, particularly effective for its particular purposes.

Golf practicing devices, utilized to provide instant information to the golfer, should impart all of the information that is required to improve the golfer's skill and effectiveness. Amongst such skills is the need to drive a ball a pre-selected distance, in a selected direction along a plane extending parallel to the playing course, and, within a plane extending normal to the surface of the playing course. The first measurement—distance—is primarily a function of the amount of force imparted to the ball so as to drive same the selected distance. The second measurement (direction of flight relative to a desired direction) becomes of paramount importance, since a small angular deviation, imparted to the ball in error, can result in a substantial deviation from the exact location to which the golfer is directing the ball. The loft that the ball achieves, during its flight, contributes somewhat to the distance that the ball will travel, but additionally contributes substantially to the ability of the ball to reach a height sufficient to travel above or over vertical barriers, such as inclines, trees, and the like. Thus, the loft that the ball achieves, during flight, becomes an important measurement to permit a golfer to improve his skills. The present invention is capable of instantly measuring each of the aforementioned three characteristics imparted to the ball by the practicing golfer and displays same in a non-interpretive fashion to the golfer and others about him, such that he can immediately adjust his ball striking techniques and quickly improve his effectiveness and efficiency thereby.

These objects, as well as other objects of the present invention, will become more readily apparent after reading the following description of the accompanying drawings.

DESCRIPTION OF THE PREFERRED EMBODIMENT

Figure 1:
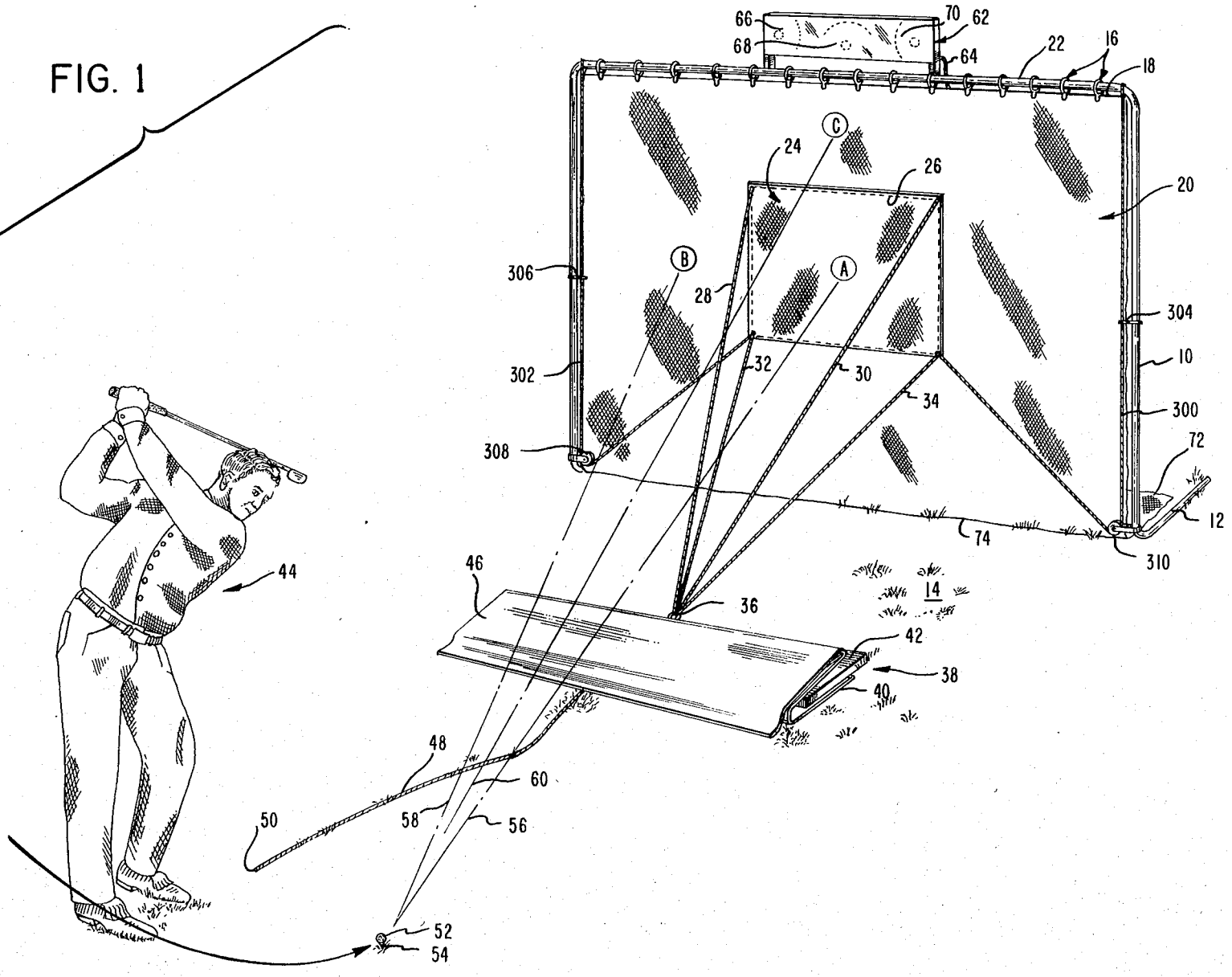
FIG. 1 is a perspective view of the present invention.

The structure and method of fabrication of the present invention is applicable to a golf practicing apparatus comprising a rigid frame, from which is suspended a fabric-like net or screen, draped in a vertical positon. At least 2 shroud lines extend from such fabric-like net, and communicate to a hinged plate, hingably secured to a rotatable disc, the disc in turn pivotably secured to a supporting plate, nesting upon the ground. When the shroud lines assume a condition determined by the ball impacting in a region near the center of the screen, the hingable plate will firstly assume a position other than being parallel to the supporting plate, or the disc upon which it is hingably secured. Then, the hingable plate will return to its initial parallel position, only after driving an indicator lever to assure a position which illustrates the loft taken by the driven ball. A guide line extends from the distal most end region of the hingable plate, having a free end communicating to the indicating lever. The indicating lever, in turn, is coupled to a release or reset mechanism, which mechanism will be later manipulated by the user, in preparation for the next ball directed at the screen. The lever assumes a position reflective of the angle taken by the hingable plate, indicating the loft of the ball, when it strikes the screen.

Similarly, when the ball strikes the screen, the shroud lines are pulled rearwardly, in the direction of the ball's travel, with a force proportional to the force imparted on the ball by the golf club employed by the practicing golfer. The shroud lines terminate in a spring loaded mechanism, portions of which are flexible cables and springs, such that a common line, coupled to all of the shroud lines, is equipped with a pointer, and assumes a position moving the pointer along a scale located on the supporting plate. Thus, the force of the moving ball causes the pointer to assume a position proportional to the total force imparted to the golf ball, regardless of direction. The common shroud line is kept in its extended stressed condition, by the use of a one-way clutch mechanism, compelling the common shroud line to remain in its most stressed position, keeping the distance pointer at its most extended location along the scale. The scale is calibrated in yards, providing the golfer with an immediate read-out of the total of all forces imparted to the ball.

The direction that the ball takes is measured by the rotation of the circular disc, rotationally secured to the supporting plate. When the shroud lines are compelled to assume an angle by the leftmost or rightmost point of impact of the ball upon the screen, the entire disc rotates to such direction, providing yet another indication of the deviation of the ball's intended path—the center of the screen, when viewed in the left or right direction.

Upon exerting a pulling force on the release cord, the one-way clutch is released, allowing the now pretensioned common shroud line to assume a non-stressed condition, returning the distance pointer to its zero position. Similarly, a cable-like linkage redirects the circular disc to its normal or starting position, and such that the indicating lever, carried on the disc, returns to its starting position.

An electrical readout device may be secured to the present invention—if desired—utilizing strain gauges, potentiometers or other electrically sensitive devices to measure the stress on the common shroud line, the direction that it assumes horizontally, and the direction that it assumes vertically as by measuring the tension in the common shroud line, the direction assumed by the disc, and the altitude assumed by the distalmost end of the hingable plate, respectively.

Now referring to the figures, and more particularly to the embodiment illustrated in FIG. 1, showing frame work 10, supported by leg 12, on terrain surface 14. A plurality of wire-like rings 16 secure uppermost edge 18 of screen 20 to uppermost portion 22 of frame 10. Screen 20 may be fabricated from any suitable fabric, such as canvas, polyamide mesh, provided that the weave is sufficiently small to prohibit trapping or the passage of the golf balls within the open weave portions of screen 20. Region 24, of screen 20, may be disposed centrally, but preferably below center of screen 20 and within the edges of screen 20, and may be fabricated by a layer of screen-like material 24 stitched around its periphery to screen 20. Dotted lines 26 depict the stitches which are used to secure the smaller panel of screening 24 to the substrate screening 20. If desired, panel 24 may be omitted as long as a cord, not shown, is stitched to or interwoven with screen 20 at dotted lines 26, outlining the same area as would be depicted if screen 24 were to be utilized. Shroud lines 28, 30, 32, and 34 have one end thereof secured to the corners of rectangular area 24 or its boundary. If desired, a minimum of 2 lines may be employed. The other end of shroud lines 28, 30, 32, and 34 converge at point 36, located adjacent apparatus 38. Apparatus 38 comprises transparent plastic-like cover 40 disposed, protecting supporting plate 42. Golfer 44 may peer through transparent portions 46 of transparent plastic-like cover 40, so as to view the uppermost surface of supporting plate 42. Emanating outwardly from apparatus 38, is flexible relief cord 48. End 50 of cord 48 is positioned close to the location of the golfer. When the golfer concludes driving ball 52 from tee 54, the golfer must reset the apparatus, by pulling on cord 48. Dotted lines 56 depict a path taken by ball 52, such that ball 52, when striking screen 20, ends up at location A. Similarly, dotted lines 58 depict a ball arriving at screen 20 at location B. Dotted lines 60 depict ball 52 arriving at location C on screen 20. Electronic display board 62 is secured to uppermost horizontal member 22 of frame 10. Cable 64 electrically couples display board 62 to plate 42. Scale 66 may be utilized to display the loft assumed by ball 52 whilst scale 68 may be utilized to display the angular direction assumed by ball 52 relative to point A extending in a horizontal plane. Display 70 may be utilized to illustrate the amount of impact force imparted on screen 20 by ball 52, thereby depicting the potential distance that ball 52 would have traveled had it not been interrupted in its path by screen 20. Portion 72, of screen 20, rests upon surface 14, thereby prohibiting ball 52 from passing unhindered beneath frontmost, lowermost edge 74 of screen 20. Lines 300 and 302 start at the uppermost end thereof by being tied to frame 10 and its leftmost and rightmost corners. Then, elastic, stretchable lines 300 and 302 pass through eyelet, loop-like devices 304 and 306, having one end secured to the vertical rails of frame 10. The other ends of devices 304 and 306 are used to permit lines 300 and 302 to pass therethrough. Lines 300 and 302 are intermittently loosely interwoven in the intertices of screen 20, adjacent the upright legs of frame 10. Pulleys 308 and 310 are used to permit lines 300 and 302 to pass over same so as to end up at the lowermost diverse corners of area 24, by permitting lines 300 and 302 to pass in front of screen 20, thus adding a measure of downward and lateral support to the central region of screen 20.

Figure 2:
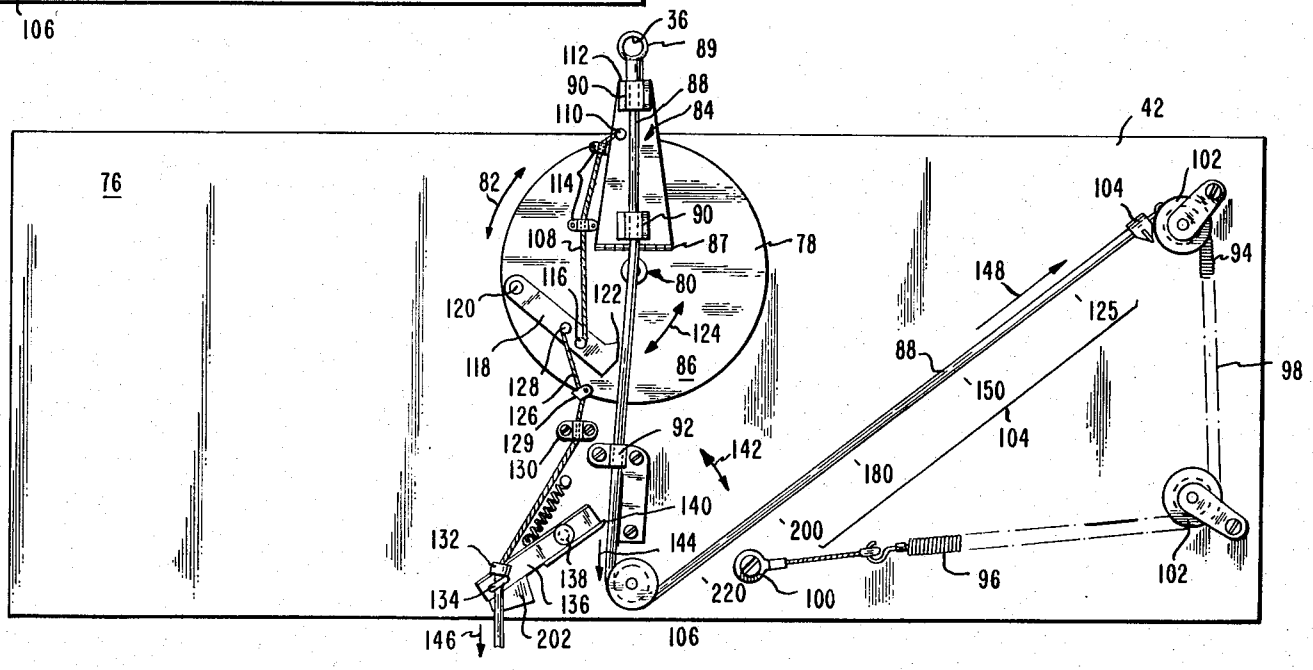
FIG. 2 is a plan view of a portion of the apparatus depicted in FIG. 1.

FIG. 2 illustrates supporting plate 42 having an uppermost surface 76. Circular disc 78 is pivotably secured to surface 76 by way of pivot 80. Disc 78 is free to rotate in the direction of arrows 82. Hingable plate 84 is coupled to uppermost surface 86 of circular disc 78, utilizing piano hinge 87 therefor. Loop 89 is secured to cable 88, and it used to capture the proximal ends of shroud lines 28, 30, 32 and 34, shown in FIG. 1 at point 36. Cable 88 slidably passes through guides 90, secured to hingable plate 84 and guide plate 92, secured to surface 76. Helical springs 94 and 96 connect cable 88 to cable portion 98, terminating at screw head 100. Pulleys 102 guide springs 94 and 96, cable 98 and 88, along a predetermined path. If desired, cable 98 and springs 94 and 96 may be replaced with a unitary stretchable, elastic cord-like material. Pointer 104 is secured to cable 88 and is shown residing adjacent uppermost pulley 102. Scale 104, comprises indicia located on surface 76, disposed along a line formed by the periphery of uppermost pulley 102 and pulley 106. Cable 108 has end 110 secured intermediate the hinged end of hingable plate 84 and the distalmost end 112 thereof. Guides 114 are secured to surface 86 of circular disc 78, through which pass cable 108. End 116 of cable 108 is secured to arm 118. Pivot rod 120 permits indicating lever 118, to pivot thereabout, such that end 122 is free to move in the direction of arrows 124. Cable 126 has end 128 thereof coupled to lever 118, and other regions thereof passing through guide 129, shown secured to disc 78, and guide 130, shown secured to surface 76. Protrusion 132 is positioned on cable 126, such that this protrusion is shown disposed in touching engagement with guide 134. If desired, protrusion 132 may be a knot in cable 126. Guide 134 is secured to clutch arm 136. Pivot 138, shown in dotted lines, permits end 140, of clutch arm 136, to move in the direction shown in arrows 142. End 140, engages a side edge of cable 88, such that cable 88 may move in the direction of arrow 144, only when a force is exerted upon cable 126, in the direction of arrow 146. At other times, as when springs 94 and 96 are extended, end 140, and a vertical wall portion of guide plate 92, pinches cable 88, prohibiting the further motion of cable 88, in the direction of arrow 144 and in the direction of arrow 148.

Figure 3:
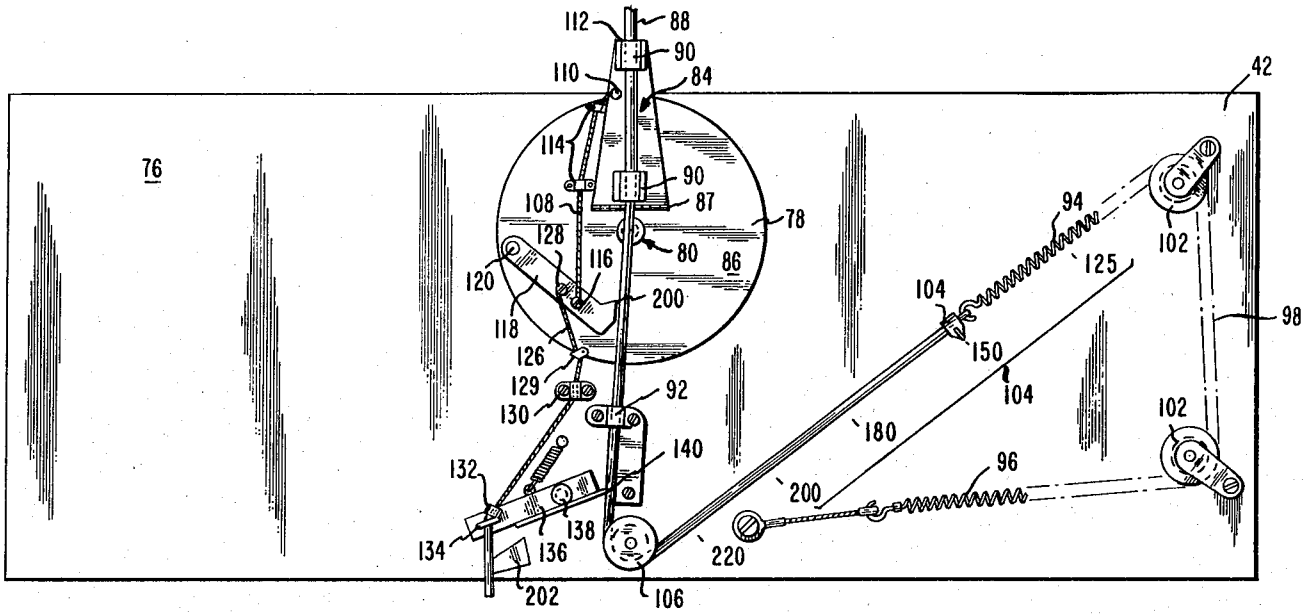
FIG. 3 is a plan view of a portion of the apparatus depicted in FIG. 1, showing the apparatus in a ball measurement position.

FIG. 3 illustrates the position of the components shown in FIG. 2, when ball 52, shown in FIG. 1, strikes point A. In this case, pointer 104 is disposed adjacent indicia labeled "150". The angular portion of disc 78 indicates a centered impact of ball 52, when viewed from left to right, upon screen 20. Springs 94 and 96 are shown in their tensioned elongated condition, and are maintained in that state, due to edge 140 contacting cable 88. It should be noted that pointed end 200, of lever 118, has been slightly pivoted about pivot rod 120, since ball 52, shown in FIG. 1, did achieve a modest "loft", represented as midway between the uppermost and lowermost horizontal edges of screen 20. Obviously, the choice of the physical parameters of lever 118, and hinge plate 84 can be such that ball 52, striking at point A, registers a modest upward force being imparted to ball 52. In the position shown, clutch arm 136 is illustrated disposed away from stop block 202.

Figure 4:
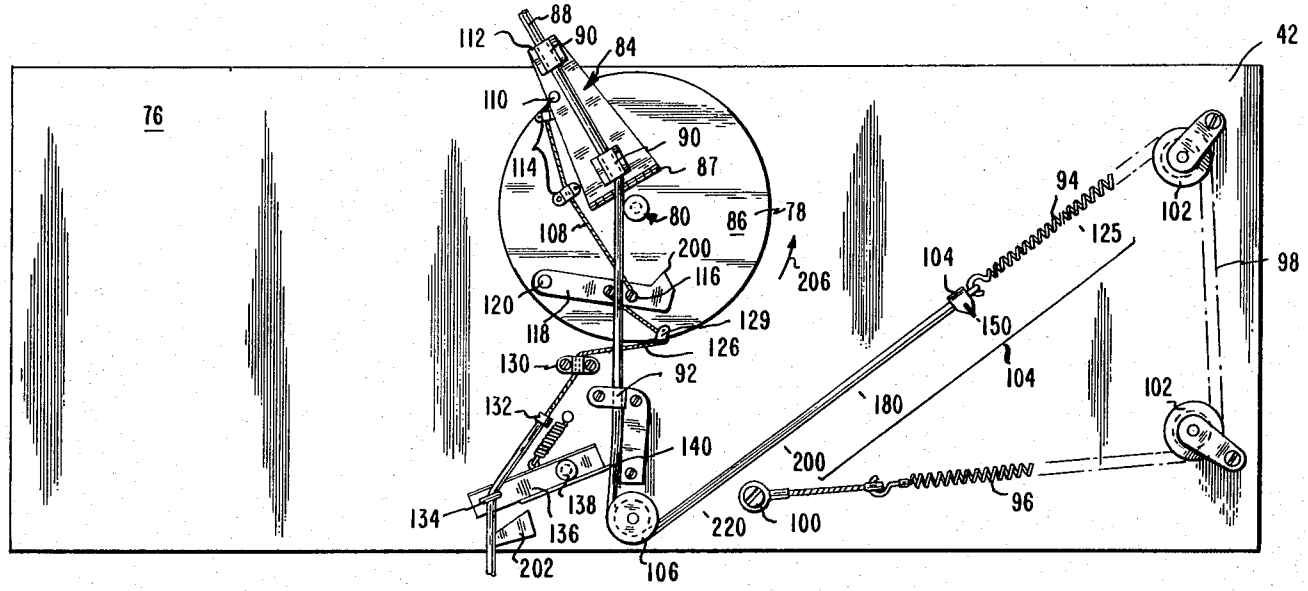
FIG. 4 is a plan view of a portion of the apparatus depicted in FIG. 1, showing the apparatus in a ball measurement position.

FIG. 4 illustrates the condition of the components of the present invention, shown in FIG. 2, when taken after ball 52—shown in FIG. 1—contacts screen 20 at point B. As can be seen, point B is a modest loft position, and represents a ball which has been directed away from a path depicted by dotted lines 56, when traveling along dotted lines 58, all shown in FIG. 1. When such is the case, shroud lines 28 and 32 are displaced rearwardly, away from golfer 44, a greater distance than would be shroud lines 30 and 34. Shroud lines 28 and 32 impart a non-centered force to point 36—illustrated in FIG. 2. Also, when such occurs, circular disc 78 tends to rotate in the direction of arrow 206, causing circular disc 78 to pivot about pivot rod 80. Also, when this occurs, loft indicating lever 118 pivots about pivot rod 120, causing pointer end 200 to assume a position slightly closer to pivot rod 80. It can also be seen, the actual ball striking force imparted to screen 20, shown in FIG. 1, as measured, happens to be identical to the forces variously shown in FIGS. 3 and 4, excepting as to direction. Hence, pointer 104 again points to "150∞.

Figure 5:
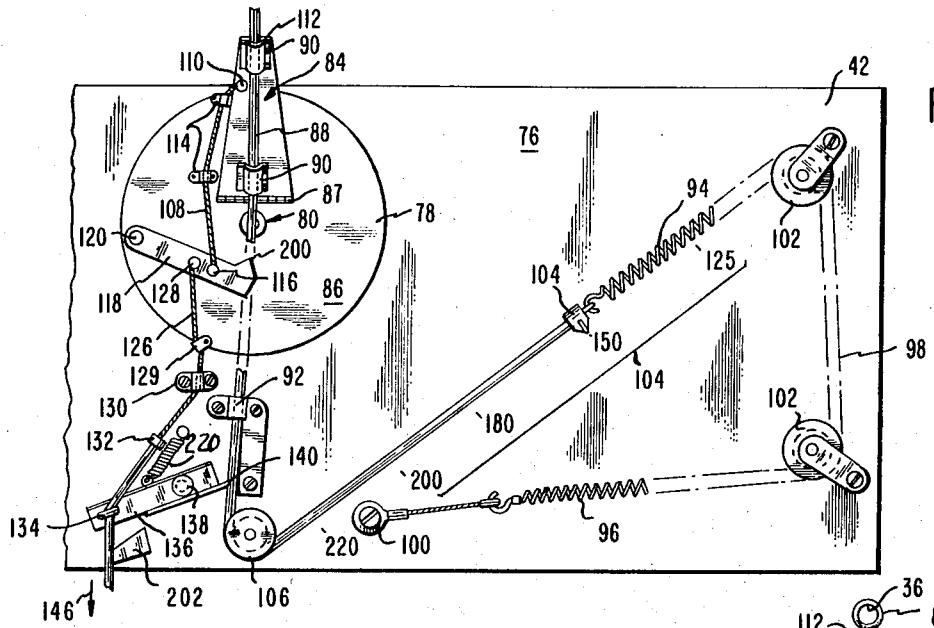
FIG. 5 is a plan view of a portion of the apparatus depicted in FIG. 1, showing the apparatus in a ball measurement position.

FIG. 5 illustrates the apparatus shown in FIG. 1, when ball 52 impacts screen 20 at point C. If such be the case, and assuming that the force of impact of ball 52, shown in FIG. 1, happens to be a force imparted to such ball as in FIGS. 3 and 4, so as to cause pointer 104 to reach or stop at indicia "150" on the scale-indicating the amount of distance that ball 52 would achieve, measured by striking the screen. However, it can be seen that ball 52 travels along dotted lines 60, shown in FIG. 1, so as to cause hingable plate 84 to have the distalmost end 112 thereof rise significantly above surface 76. Cable 108 imparts the rise of distalmost end 112 to loft indicating lever 118, such that pointer end of 200 thereof is caused to come substantially closer to pivot rod 80, than in the cases of FIGS. 2, 3 or 4. The proximity of pointed end 200 to pivot rod 80 indicates the amount of loft imparted to ball 52, regardless of the amount of force transmitted by it to screen 20 or the horizontal location of such ball, when impacting upon screen 20. The loft measurement is insensitive to the angle taken by the struck ball, relative to its leftmost or rightmost direction. Here again, it should be noted that clutch arm 136 is disposed out of touching engagement with block 202, due to the tensioning of cable 98 and springs 94 and 96. It should be noted that a vertical edge at clutch arm 136 bears against a portion of cable 88. A wall-like portion of guide plate 92, located running parallel to a portion of cable 88, adjacent distal end 140 of clutch arm 136, serves to prevent cable 88 from slipping when pinched between distal end 140 and said vertical wall of guide plate 92. Spring 220 is used to bias end 140 of clutch arm 136 towards cable 88, thereby capturing cable 88 against motion in the direction of arrow 146, unless release cord 126 is pulled in the direction of arrow 146.

Figure 6:
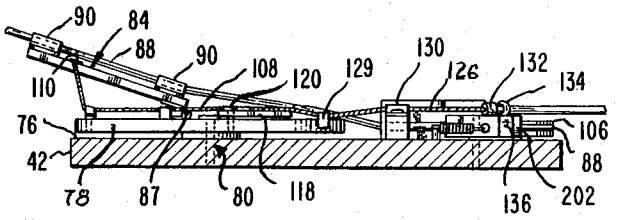
FIG. 6 is a side elevational view of a portion of the apparatus shown in FIG. 5.

FIG. 6 illustrates mounting plate 42 upon which is mounted circular disc 78. Hingable plate 84 is shown in an elevated position where cable 108 is shown linking to hingable plate 84 and to loft indicating lever 118. Release cord 126 is shown coupled to clutch bar 136. When pulling release cord 126, as can be seen in FIG. 2, clutch end 140 is moved out of communication with cable 88, allowing cable 88 to be released from stress. Hingable plate 84 will always return to its neutral position, being a position where the lateral surfaces of such hingable plate are disposed parallel to surface 86 of circular disc 78, prior to pulling release cable 126. Pulling upon release cable 126 resets pointed end 200 to its furthest most point away from pivot rod 80.

A strain gauge may be installed at bolt 100, measuring the strain or force imparted upon cable 98, which is coupled to it. Such strain gauge when being stressed, can produce an electrical signal, in a manner well known in the art, to operate scale 70, shown in FIG. 1, to depict the force imparted on every struck ball 52. Likewise, a shaft operated potentiometer, not shown, may be utilized so as to have its shaft linearly coupled to the shaft comprising the pivot shaft of pivot 80. In this fashion, the angular rotation of disc 78 can be electrically monitored so as to display its angular position relative to surface 76 upon scale 68, shown in FIG. 1. Similarly, another rotational potentiometer may be installed coupled to hinge 87 whose circular shaft operates as plate 84 moves. If such be the case, such potentiometer could be utilized, in a manner well known in the art, to signal the electrical apparatus to illustrate on scale 66, shown in FIG. 1, the up-down displacement of any ball 52 impinging upon screen 20—as shown in FIG. 1.

As can be seen, plate 42 can be fabricated from any convenient rigid material. Circular disc 78 as well as hingable plate 84 may be fabricated from plastic, metal, wood, or other suitable durable and inexpensive materials. Cables—shown in the present invention, may be fabricated from an endless tubing material, such as cotton, polyamide monofilaments, or the like. Springs 94, 96 and 220, shown in FIG. 5, may be fabricated from any resilient material, such as steel or plastic unless springs 94 and 66 are replaced and by making cable portion 98 of cabled 88 out of a stretchable elastic material. A force required to overcome spring 220, shown in FIG. 5, used to assist clutch arm 136 in locking against locking end 140 thereof against cable 88 and to provide a minimum threshold of force required to be exerted upon cable 126 or cable 50, shown in FIG. 1, must be applied to cable 48 to release cable 88. Protrusion 132 secured to cable 126 operates on guide 134 so as to permit pivot arm 136 to be moved when a force is exerted on cable 48, shown in FIG. 1, in the direction of arrow 146. Cable 48, is shown as an extension to cable 126, being easily replaceable to overcome the wear and tear normally experienced by cable 48, being at or under foot of golfer 44.

I have discovered that making the size of area 24, shown in FIG. 1, inordinately large, prevents the loft indicating mechanisms from operating efficiently. Similarly, I have discovered that making area 24, shown in FIG. 1, too large in a horizontal direction, tends to minimize the rotational capabilities of disc 78, thereby diminishing the ability of the golfer to experience an effective indicator of the horizontal angular position assumed by ball 52. The stiffer cross-section, found in area 24 relative to other areas of screen 20, permits shroud lines 28, 30, 32 and 34 to operate more effectively as up and down as well as side to side indicators, so as to compel point 36 to move upwardly or downwardly, or from or to left or right, in an accurate and repetitive manner. Further, proportioning the size of area 24 with the thickness and flexibility characteristics of the reinforcing section of screen required to define area 24, provides a life-like target area for the golfer to "sight" upon, whether same is a square or a unilateral triangle—in which case, 3 shroud lines can be employed, one each at each corner of the triangle, or, a pair of shroud lines, disposed along a line running in any direction. Of course, one or more shroud lines may be utilized to obtain force of impact, loft, as well as left/-right displacement measurements of struck balls. Stakes, not shown, may be utilized to secure apparatus 38, shown in FIG. 1, to surface 14—if required. In the event that the electronic readout elements, shown as part of panel 62 are utilized, then, portions 46 of apparatus 38 need not be transparent but should be ridged since the mechanical apparatuses disposed between portion 46 and surface 76 are subject to damage when balls 52 rebounds from screen 20.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appended claims.

The embodiment of the invention in which an exclusive privilege or property is claimed are defined as follows:

1. A practice golf net device comprising a fabric-like screen, a frame, means to drape said screen from said frame in substantially a vertical plane, at least one shroud line, one end of each of said at least one shroud line being disposed secured to said flexible screen the other end of each of said at least one shroud line being coupled together at a point, a plate, a disc, said disc journaled for rotation on a lateral surface of said plate, a hingable plate, one end of said hingable plate hingably secured to said disc, the other end of said hingable plate being disposed free to move upwardly and outwardly from an uppermost surface of said disc into one of a plurality of positions, means to slidably secure a first cable along a surface of said hingable plate, one end of said first cable being secured to said each other end of said at least one shroud line at said point, means to releasingly clampingly engage said first cable against slidable motion, means to bias said free end of said hingable plate from every said one of said plurality of upward and outward positions, an indicating lever, said indicating lever pivotably secured to said disc, means to angularly position said indicating lever at selected locations reflecting said diverse upward and outward location of said free end of said hingable plate, means to resettably reposition said angular position assumed by said disc, said means to resettably reposition including means to rotationally position said disc at one of a plurality of selected angles of rotation dependent upon said one end of said at least one shroud line being displaced a distance away from a position attained by said one end of said at least one shroud line when said first cable has not been slidably positioned in clamping engagement by said means to releasingly clampingly engage said first cable, a pointer, said pointer secured along the length of said first cable, means to resettably retain said pointer at a selected position when said screen is impacted by a golf ball, said means to resettably retain said pointer including visual access means to visually access said pointer and a distance depicting scale disposed on said plate, a second cable, said second cable being coupled to said hingable plate, said second cable being coupled to said indicating lever, said visual access means including means to visually access said pointer and said distance depicting scale.

2. The apparatus as claimed in claim 1 wherein said means to rotationally couple said disc to said plate comprises a pivot rod, said pivot rod being secured to said plate, said pivot rod rotationally securing said disc to said plate.

3. The apparatus as claimed in claim 1 wherein said first cable is coupled to at least one spring, said at least one spring having one end thereof coupled to a point fixed on said plate, the other end of said spring being coupled to said first cable.

4. The apparatus as claimed in claim 1 wherein said means to releasingly, clampingly engage comprises a clutch-like arm, said clutch-like arm being pivotably secured to said plate, the distal end of said clutch-like arm being releasably touchingly and clampingly engageable with said first cable, a third cable, said third cable coupling to said clutch-like arm and said second cable, means to release said first cable for free slidable motion.

5. The apparatus as claimed in claim 4 further comprising a protrusion, said protrusion secured to said third cable, said protrusion being releasably touchingly engagable with a guide loop, said guide loop being secured to said clutch-like arm.

6. The apparatus as claimed in claim 4 further comprising means to position said hingeable plate at an angle relative to a lateral surface of said disc upon the free end of said hingeable plate being positioned upwardly and outwardly of said lateral surface when said golf ball is caused to strike said screen at said diverse locations, said means to position said hingeable plate comprising gravity.

7. The apparatus as claimed in claim 4, further comprising means to position said disc at an angular location dependent upon the lateral position said golf ball strikes said screen, said means to position said disc including means to retain said disc at said angular location until said third cable experiences a force directed away from said plate.

8. The apparatus as claimed in claim 4 further comprising said means to releasably clampingly engage said first cable including means to release said first cable for slidable motion upon said third cable experiencing a force directed to it in a direction away from said plate.

9. The apparatus as claimed in claim 6, further comprising an indicating lever means to position said indicating lever at said diverse locations each reflective of the maximum angular position taken by said hingeable plate.

10. The apparatus as claimed in claim 5 further comprising a pointer, said pointer being secured to said first cable, indicia, said indicia comprising a distance scale and being disposed on said plate adjacent a pathway of said pointer.

11. The apparatus as claimed in claim 4, including means for said first cable to be tensioned to an extent dependent upon the total impact force experienced by said screen when said golf ball strikes same, independent of the point of impact of said golf ball there upon.

12. The apparatus as claimed in claim 4 further including means to reposition said disc at a neutral position upon said third cable is subjected to a force directed away from said plate.

13. The apparatus as claimed in claim 11 comprising a spring, one end of said spring being secured to said first cable, the other end of said spring being secured to said plate, said spring being tensioned when said golf ball strikes said screen.

14. The apparatus as claimed in claim 8 wherein said means to releasably clampingly engage said first cable comprises a clutch-like arm, said clutch-like arm pivotably secured to said plate, one free end of said clutch-like arm being biased towards said third cable by a spring, said third cable carrying a protrusion, an eyeloop, said eyeloop affixed to said clutch-like arm adjacent said protrusion whereby said arm is manually positioned so as to have said free end thereof moved out of touching engagement with said first cable upon said third cable being positioned to have said protrusion engaging said eyeloop.

15. The apparatus as claimed in claim 1 wherein said at least one shroud line comprises four in number, each of said four shroud lines defining the corners of a right angle rectangle.

* * * * *